United States Patent [19]

Abendroth

[11] 4,131,421

[45] Dec. 26, 1978

[54] COKE OVEN CONSTRUCTION

[75] Inventor: Werner Abendroth, Haltern, Germany

[73] Assignee: Firma Carl Still Recklinghausen, Germany

[21] Appl. No.: 840,960

[22] Filed: Oct. 11, 1977

[30] Foreign Application Priority Data

Oct. 13, 1976 [DE] Fed. Rep. of Germany ..... 2646117

[51] Int. Cl.[2] ..... F27D 1/00; F27D 1/18

[52] U.S. Cl. ..... 432/247; 110/173 R; 202/248

[58] Field of Search ..... 126/191, 197; 432/247; 110/173 R; 202/246, 248

[56] References Cited

U.S. PATENT DOCUMENTS

| | | | |
|---|---|---|---|
| 1,301,144 | 4/1919 | McKee | 110/173 R |
| 2,081,114 | 5/1937 | Anderson et al. | 110/173 R |
| 2,152,510 | 3/1939 | Turner | 110/173 R |
| 2,157,569 | 5/1939 | Potter | 110/173 R |
| 2,442,348 | 6/1948 | Exum | 202/248 |
| 4,032,409 | 6/1977 | Knappstein et al. | 202/248 |

*Primary Examiner*—John J. Camby

*Attorney, Agent, or Firm*—McGlew and Tuttle

[57] ABSTRACT

A coke oven construction for the fastening of furnace door frames to the armor of horizontal, blockwise arranged coke oven furnaces, comprises a furnace which has an armor plate with a portion offset inwardly toward the furnace which carries a furnace frame which is sealed to the armor plate. A metal plate overlies the portion of the armor plate which extends outwardly from the frame and it has an edge which projects from the armor plate in a direction toward the frame. A hooked member is engaged over the edge of the plate and an eye bolt is threaded into the hooked member and provides a bolt for the pivotal mounting of a toggle which has one arm which bears against the frame and another arm which extends upwardly alongside an anchor stand which is mounted over the plate of the armor. A pressure plate is positioned between the anchor stand and a set screw or bolt member which is extended through the second arm portion of the toggle and it may be adjusted to vary the pressure acting on the second arm to force it outwardly from the anchor stand and the first arm into engagement with the frame member.

7 Claims, 2 Drawing Figures

COKE OVEN CONSTRUCTION

FIELD AND BACKGROUND OF THE INVENTION

This invention relates in general to coke ovens and, in particular, to a new and useful construction for the fastening of furnace door frames to the armor of horizontal, blockwise arranged coking furnaces, the furnace door frames being designed as block frames or rib frames and pressed with a gasket onto the head armor, with an armor plate being clamped between anchor stand and head armor to which the head armor is fastened by means of a screw connection.

DESCRIPTION OF THE PRIOR ART

In one known embodiment, according to the state of the art, the screw connection is designed as a screw hook, with its hook gripping around the edge of the armor plate. This mode of fastening proved to be disadvantageous in that, in assembly, the compression and tension exerted by the screws cannot be set to a magnitude or can only be so set at high technical expense, which makes it possible to tighten the screws too much in assembly, thus bending or ripping off the hooks. By the same token, the normal tension and compression in assembly can be increased through heating, leading to deformations and to the tearing off of the hooks and screw bolts. On the other hand, the screw bolts can become loose and drop out of their guiding means if tension and compression are diminished or entirely nonexistent.

SUMMARY OF THE INVENTION

The present invention provides a furnace door fastening which will no longer tear off because of excessive tension or drop out of its guiding means for lack of tension. With the invention, a fastening mode is provided which is not affected by thermal expansion of the furnace masonry.

A threaded part is mounted to the armor plate and a bolt is screwed to the part and it is rotatably fastened to a toggle whose one arm pushes against the furnace door frame and whose other arm carries a pressure plate or sliding plate at its end, which finds its support against the anchor stand. According to a special embodiment of the invention, the threaded part is designed in the form of a hooked threaded part gripping around the edge of the armor plate.

Eye bolts are preferably used as the bolts to connect the toggle and the threaded part, and it is also recommended to spring-load the pressure plate against the toggle additionally by means of Belleville washers and to design the anchor stand as double T-beam or similar sections, against the web of which the pressure plate finds its support.

The thermal expansion motions of the masonry also cause the furnace frame to be pushed outwardly and thereby cause the pressure plate to slide on the anchor stand web, as it would also in the event of thermal expansion of the anchor stand itself, without thereby changing the pressure against the furnace frame on the one hand, and against the armor on the other. Therefore, these fastening elements cannot loosen up, nor can they drop out during their assembly.

Accordingly, an object of the invention is to provide an improved fastening of a furnace door frame to an armor of a horizontal, blockwise arranged coking furnace which includes a hook member which is held on a projecting plate over the arm and which provides a mounting for a pivot member for pivotally mounting a toggle which has one arm which bears against a frame which is carried on the armor and a pressure plate which is supported against an anchor stand which extends outwardly from the armor and overlies the metal plate and which further includes an adjustable threaded member which may be adjusted for bearing the bearing pressure against a pressure plate which is carried on the face of the anchor stand so as to vary the pressure of an arm portion of the toggle which acts against the frame.

A further object of the invention is to provide a coke oven construction for the fastening of furnace door frames which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
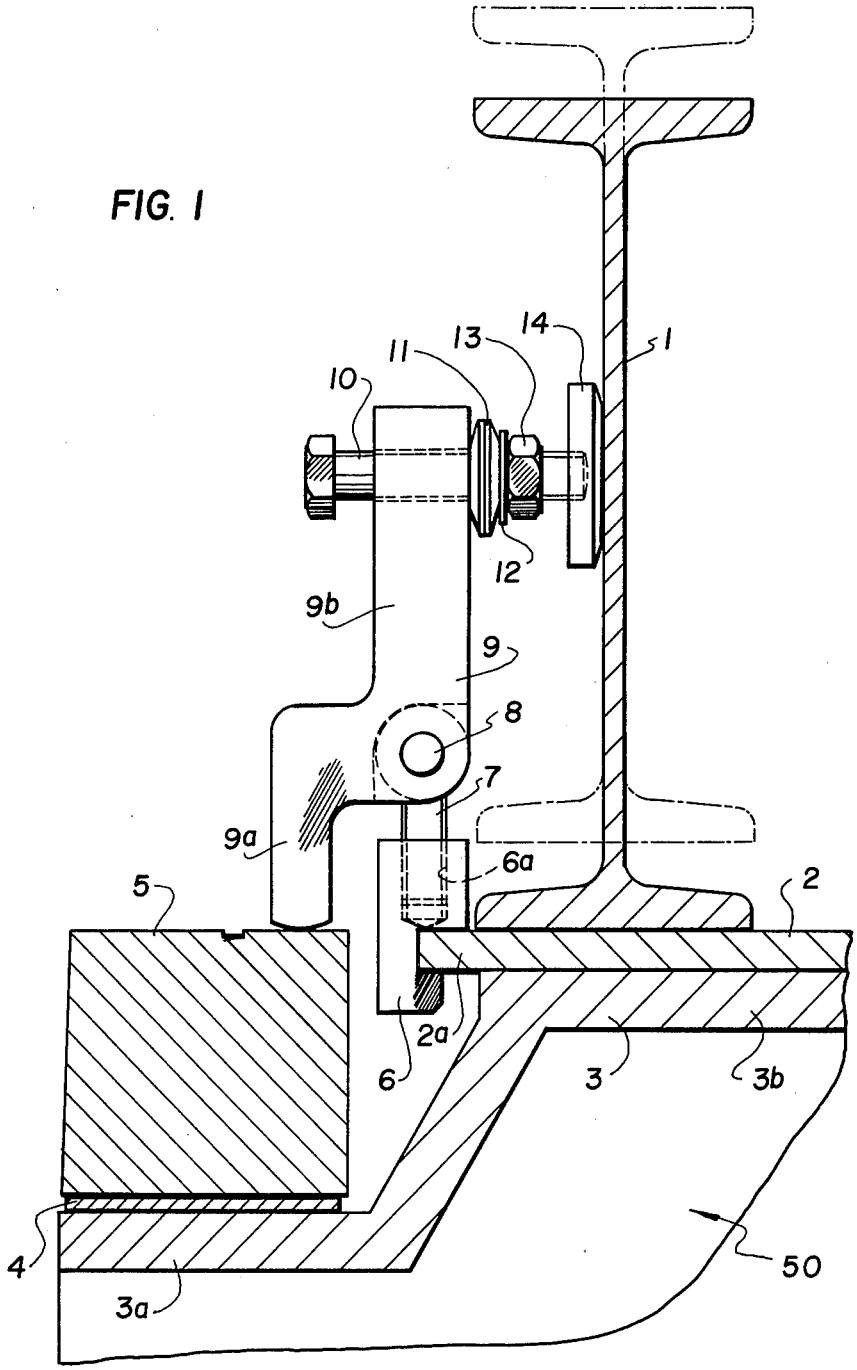
FIG. 1 is a partial, horizontal sectional view of a coke oven construction constructed in accordance with the invention.

Referring to the drawings in particular, the invention embodied therein, in FIG. 1, comprises a coke oven, generally designated 50, which has a furnace wall which includes an armor plate or cast armor 3 having a frame portion **3*a* around an opening to which is secured a furnace frame 5 through an intermediate gasket 4 which is secured between the frame 5 and the armor plate 3, such as by adhesive. The armor plate 3 also includes an outwardly offset portion 3*b* which is set outwardly from the frame portion 3*a* and a metal plate 2 is mounted over this portion and it has an edge 2*a* which extends outwardly from the armor plate in a direction toward the frame. An anchor stand 1 is mounted on top of the plate over the offset portion 3*b*** of the furnace.

In accordance with the invention, a hooked member 6 is engaged over the edge **2*a* of the plate 2 and it provides a support for a pivot member in the form of an eye bolt 7 and a threaded bolt 8 for a toggle 9. The eye bolt 7 is threaded into a receiving recess 6*a* of the hook member 6. The toggle member 9 has an arm portion 9*a* which bears inwardly against the frame 5 and it has another arm portion 9*b* which extends upwardly or outwardly alongside an anchor stand 1 positioned on the plate 2. Pressure is brought to bear against a pressure piece 14 positioned alongside the face of the anchor stand 1 by a set screw or bolt 10 which is threaded into the outer end of the arm portion 9*b*. The construction includes a nut 13 which may be adjusted along the bolt 10 for changing the pressure exerted against the furnace door frame 5 by the arm 9*a* and the pressure acting on the pressure piece 14 on the anchor stand 1. This type of fastening is provided on both sides approximately at each meter of length of the frame. The construction also includes a Belleville washer 11 and an ordinary washer 12. Pressure plate 14 is a sliding plate which slides against the face of anchor stand 1**.

Figure 2:
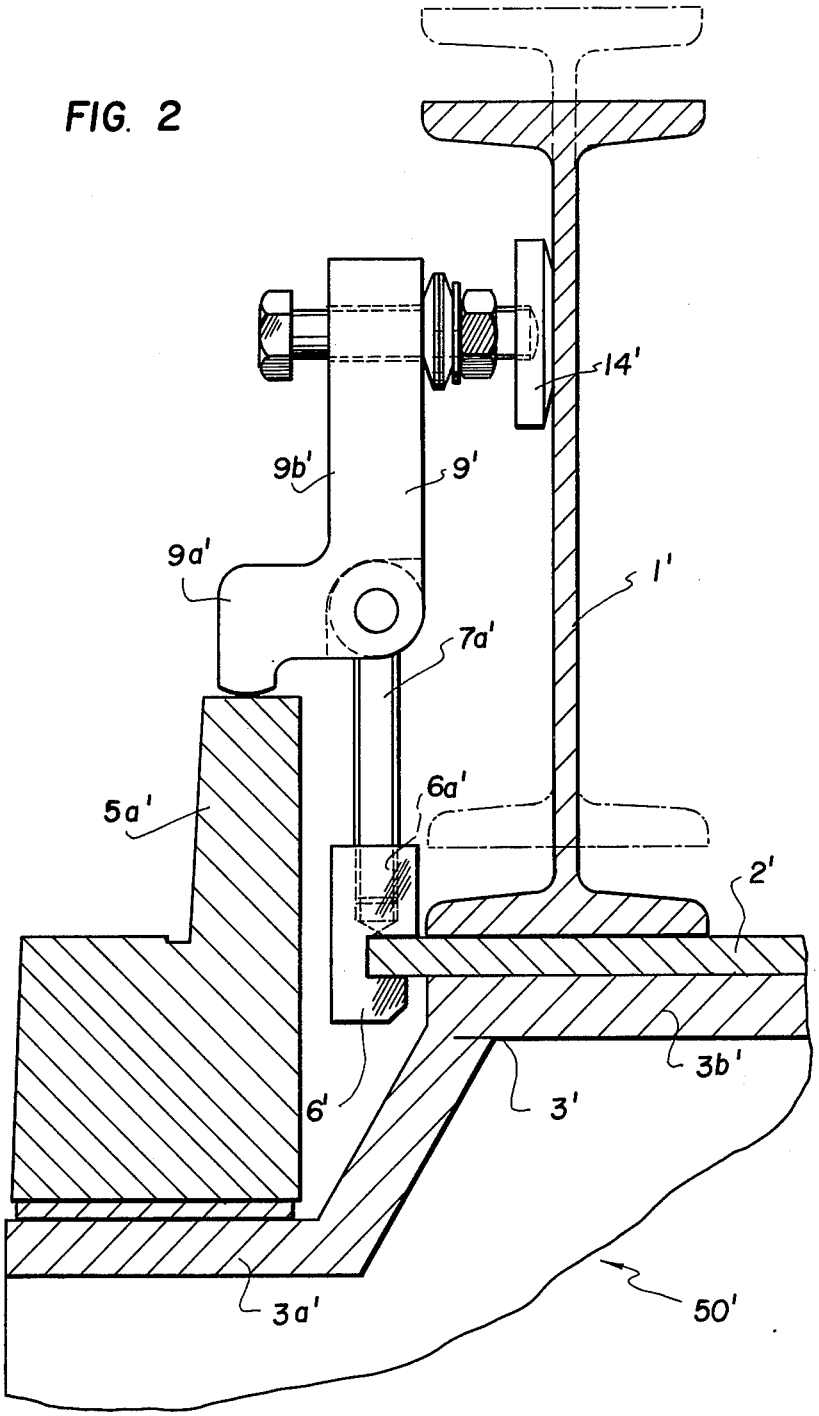
FIG. 2 is a view, similar to FIG. 1, of another embodiment of the invention.

In the embodiment of FIG. 2, a coke oven furnace 50' includes parts which are similarly designated to those of the embodiment of FIG. 1, but which have a prime added thereto.

In the embodiment of FIG. 2, the eye bolt member *7a'* is an elongated member which is threaded into recess *6a'* of the hooked part 6'. In other respects, the embodiment of FIG. 2 is similar to that of FIG. 1.

In the drawings, the condition of the anchor plates 1 and 1' when heated is shown in dotted line and this movement is caused by the expansion of the heating wall. This causes the pressure plates 14 and 14' to slide in respect to their associated anchor stands 1 and 1'. This sliding movement obviates any requirement for readjusting the screw connection.

While specific embodiments of the invention has been shown and described in detail to illustrate the application of the principles of the invention, it will be understood that the invention may be embodied otherwise without departing from such principles.

What is claimed is:

1. A coke oven construction for the fastening of furnace door frames to the armor of horizontal, blockwise arranged coking furnaces, comprising a coke oven furnace having an armor plate, a furnace frame secured to said armor plate, a metal plate overlying said armor plate and having an edge extending outwardly from said armor plate, an anchor stand mounted on said metal plate adjacent said frame and extending outwardly therefrom, a hooked member engaged over the edge of said plate, a pivot member threadedly connected to said hooked member, a toggle member pivoted on said pivot member and having a first arm extending toward the furnace and bearing against said furnace frame and a second arm extending outwardly from the furnace alongside said anchor stand, a pressure plate overlying said anchor stand and slidable therealong, a bolt threaded through said second arm and bearing against said pressure plate to press said second arm away from said pressure plate and to press said first arm against said frame.

2. A coke oven construction, as claimed in claim 1, wherein said hook member has a threaded recess, said pivot member comprising an eye bolt threaded into said threaded recess and a bolt carried by said eye bolt, said toggle being pivotally mounted on said bolt.

3. A coke oven construction, as claimed in claim 1, including spring means associated with said bolt biasing said pressure plate against said anchor stand.

4. A coke oven construction, as claimed in claim 1, wherein said anchor stand comprises an eye beam.

5. A coke oven construction, as claimed in claim 1, wherein said hook member has a hooked portion engageable on each side of said plate, said furnace armor having a recess frame portion and an outwardly extending offset portion extending outwardly from said frame portion, said metal plate overlying said offset portion and extending toward said frame portion.

6. A coke oven construction, as claimed in claim 1, wherein said frame has a rectangular cross-section.

7. A coke oven construction, as claimed in claim 1, wherein said frame is of L-shape cross-section and has an outer low portion and an inner portion which is higher than said low portion extending outwardly a further distance from said low portion, said toggle first arm bearing against said higher portion of said frame.

* * * * *